US011255641B2

(12) United States Patent
Zamorano Senderos et al.

(10) Patent No.: US 11,255,641 B2
(45) Date of Patent: Feb. 22, 2022

(54) COMPOSITIONALLY-GRADED METAL-CERAMIC STRUCTURE AND METHOD FOR MANUFACTURING THE SAME

(71) Applicant: The Boeing Company, Chicago, IL (US)

(72) Inventors: Bruno Zamorano Senderos, Huntsville, AL (US); Dennis Lynn Coad, Madison, AL (US); James Ross Dobbs, Huntsville, AL (US); Ali Yousefiani, Tustin, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/892,366

(22) Filed: Jun. 4, 2020

(65) Prior Publication Data

US 2020/0326160 A1 Oct. 15, 2020

Related U.S. Application Data

(62) Division of application No. 15/695,310, filed on Sep. 5, 2017, now abandoned.

(51) Int. Cl.
*F41H 5/04* (2006.01)
*C22C 29/14* (2006.01)
(Continued)

(52) U.S. Cl.
CPC ..... *F41H 5/0421* (2013.01); *C22C 29/10* (2013.01); *C22C 29/14* (2013.01); *B22F 3/15* (2013.01);
(Continued)

(58) Field of Classification Search
None
See application file for complete search history.

(56) References Cited

U.S. PATENT DOCUMENTS 3,633,520 A * 1/1972 Stiglich, Jr. ..... F41H 5/0421 109/82
3,802,850 A * 4/1974 Clougherty ..... C04B 35/645 428/547
(Continued)

FOREIGN PATENT DOCUMENTS

| | | |
|---|---|---|
| CN | 101531536 | 9/2009 |
| EA | 9576 | 2/2008 |
| RU | 2355991 | 5/2009 |

OTHER PUBLICATIONS

European Patent Office, "Communication pursuant to Article 94(3) EPC," App. No. 18 187 740.8 (dated Sep. 8, 2021).
(Continued)

*Primary Examiner* — Reginald S Tillman, Jr.
(74) *Attorney, Agent, or Firm* — Walters & Wasylyna LLC

(57) ABSTRACT

A compositionally-graded structure including a body having a first major surface and a second major surface opposed from the first major surface along a thickness axis, the body including a metallic component and a ceramic component, wherein a concentration of the ceramic component in the body is a function of location within the body along the thickness axis, wherein transitions of the concentration of the ceramic component in the body are continuous such that distinct interfaces are not macroscopically established within the body, and wherein the concentration of the ceramic component is at least 95 percent by volume at at least one location within the body along the thickness axis.

20 Claims, 9 Drawing Sheets

(51) Int. Cl.

| | |
|---|---|
| ***C22C 29/10*** | (2006.01) |
| *C22C 32/00* | (2006.01) |
| *B22F 3/15* | (2006.01) |

(52) U.S. Cl.

CPC ..... *B22F 2207/01* (2013.01); *B22F 2301/205* (2013.01); *B22F 2302/05* (2013.01); *B22F 2998/10* (2013.01); *C22C 32/0052* (2013.01); *C22C 32/0073* (2013.01); *F41H 5/0428* (2013.01)

(56) References Cited

U.S. PATENT DOCUMENTS

| | | | | |
|---|---|---|---|---|
| 3,804,034 | A | 4/1974 | Stiglich, Jr. | |
| 5,693,429 | A * | 12/1997 | Sengupta | B32B 18/00 428/699 |
| 6,037,066 | A | 3/2000 | Kuwabara | |
| 6,322,897 | B1 * | 11/2001 | Borchert | B22F 3/1109 428/469 |
| 7,279,230 | B1 | 10/2007 | Kerans et al. | |
| 2002/0088340 | A1 | 7/2002 | Chu et al. | |
| 2007/0224443 | A1 * | 9/2007 | Torigoe | C23C 28/325 428/632 |
| 2011/0151267 | A1 | 6/2011 | Withers et al. | |
| 2015/0137404 | A1 | 5/2015 | Tuchinskiy | |

OTHER PUBLICATIONS

Canadian Intellectual Property Office, Office Action, App. No. 3,014,231 (dated Aug. 13, 2021).

Federal Institute of Industrial Property, Office Action, with English translation, App. No. 2018126347/05 (dated Oct. 29, 2021).

China National Intellectual Property Administration, Office Action, with English translation, App. No. 201810900337.6 (dated Dec. 29, 2021).

* cited by examiner

COMPOSITIONALLY-GRADED METAL-CERAMIC STRUCTURE AND METHOD FOR MANUFACTURING THE SAME

PRIORITY

This application is a divisional of U.S. Ser. No. 15/695,310 filed on Sep. 5, 2017.

FIELD

This application relates to compositionally-graded metal-ceramic structures and, more particularly, to high-energy impact protection by way of compositionally-graded metal-ceramic structures.

BACKGROUND

High-energy impact protection is often desired for a variety of applications. As one example, space vehicles encounter various space debris, such as micrometeoroids and man-made orbital debris. Therefore, space vehicles typically include a high-energy impact protection layer to mitigate the risks associated with collisions with space debris. As another example, certain types of terrestrial vehicles, such as aircraft (e.g., helicopters) and ground vehicles (e.g., military and law enforcement vehicles), are armored to protect against ballistic threats.

In the case of ballistic threats, current state-of-the-art armor is typically constructed from ceramic materials, such as alumina, silicon carbide and boron carbide, which tend to blunt, erode, decelerate and deflect projectiles. Alumina is relatively low-cost, but requires a higher area density to achieve effective protection, thereby limiting the use of alumina-based armor to terrestrial vehicles. When weight is an important consideration, such as for aircraft, more expensive boron carbide-based armor is commonly used.

Unfortunately, the ceramic materials used to manufacture current state-of-the-art armor are relatively heavy, thereby increasing vehicle fuel consumption and limiting useful applications. Such ceramic materials also present manufacturability issues that increase overall cost and limit fabrication options. Furthermore, the ceramic materials of current state-of-the-art armor tend to shatter upon impact, leaving little or no material to impede subsequent impacts. As such, current state-of-the-art armor is relatively dense/heavy, yet offers only limited multi-hit protection.

Accordingly, those skilled in the art continue with research and development efforts in the field of high-energy impact protection.

SUMMARY

In one example, the disclosed compositionally-graded structure includes a body having a first major surface and a second major surface opposed from the first major surface along a thickness axis, the body including a metallic component and a ceramic component, wherein a concentration of the ceramic component in the body is a function of location within the body along the thickness axis, wherein transitions of the concentration of the ceramic component in the body are continuous such that distinct interfaces are not macroscopically established within the body, and wherein the concentration of the ceramic component is at least 95 percent by volume at at least one location within the body along the thickness axis.

In one example, the disclosed armor panel includes a compositionally-graded structure and an anti-spalling layer. The compositionally-graded structure includes a body having a first major surface and a second major surface opposed from the first major surface along a thickness axis, the body including a metallic component and a ceramic component, wherein a concentration of the ceramic component in the body is a function of location within the body along the thickness axis, wherein transitions of the concentration of the ceramic component in the body are continuous such that distinct interfaces are not macroscopically established within the body, and wherein the concentration of the ceramic component is at least 95 percent by volume at at least one location within the body along the thickness axis. The anti-spalling layer is adjacent to the second major surface of the body.

In one example, the disclosed method for manufacturing a compositionally-graded structure includes steps of: (1) assembling a powder layup that includes at least a first powdered material and a second powdered material, the first powdered material including a ceramic component and the second powdered material including a metallic component, the powder layup including: (a) a first layer having a first concentration of the ceramic component; (b) a second layer having a second concentration of the ceramic component and a first concentration of the metallic component; and (c) a third layer having a third concentration of the ceramic component and a second concentration of the metallic component; (2) pressing the powder layup to yield a compact; and (3) heat treating the compact.

Other examples of the disclosed compositionally-graded metal-ceramic structures, armor panels, and methods will become apparent from the following detailed description, the accompanying drawings and the appended claims.

DETAILED DESCRIPTION

Figure 1:
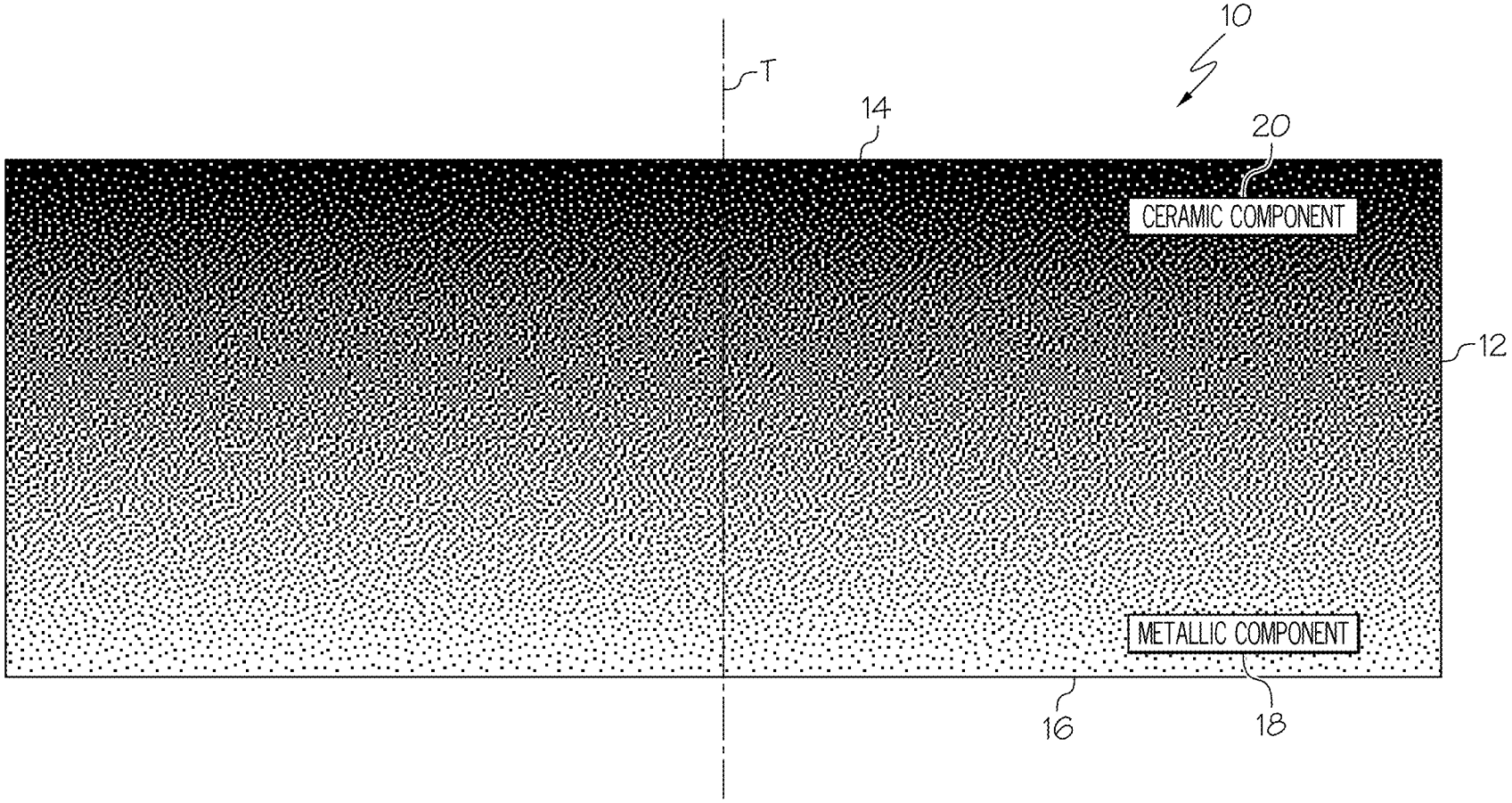
FIG. 1 is a schematic cross-sectional view of one example of the disclosed compositionally-graded structure.

Referring to FIG. 1, one example of the disclosed compositionally-graded structure, generally designated 10, may include a body 12 having a first major surface 14 (e.g., a striking surface) and a second major surface 16 (e.g., a backside surface). The second major surface 16 may be opposed from the first major surface 14 along a thickness axis T. The thickness axis T may be generally perpendicular to the first major surface 14, generally perpendicular to the second major surface 16 or generally perpendicular to both the first major surface 14 and the second major surface 16.

The body 12 of the compositionally-graded structure 10 may be a consolidated mass, and may include a metallic component 18 and a ceramic component 20. Plural metallic components 18 and/or plural ceramic components 20 may be used without departing from the scope of the present disclosure. Furthermore, other components (other than the metallic component 18 and the ceramic component 20) may be included in the body 12, whether by addition or in situ formation, without departing from the scope of the present disclosure.

The metallic component 18 of the body 12 of the compositionally-graded structure 10 may be a metal or metal alloy. As one specific, non-limiting example, the metallic component 18 of the body 12 may be a titanium alloy, such as Ti-6Al-4V. As another specific, non-limiting example, the metallic component 18 of the body 12 may be an aluminum alloy, such as a 7000-series aluminum alloy (e.g., aluminum 7075). As yet another specific, non-limiting example, the metallic component 18 of the body 12 may be a nickel alloy, such as a nickel-based superalloy (e.g., Inconel 625).

The ceramic component 20 of the body 12 of the compositionally-graded structure 10 may be a ceramic material. Various ceramic materials may be used as the ceramic component 20 of the body 12. Examples of ceramic materials suitable for use as the ceramic component 20 of the body 12 include, without limitation, titanium diboride ($TiB_2$), titanium boride (TiB), titanium carbide (TiC), chromium carbide (e.g., $Cr_{23}C_6$), silicon carbide (SiC), tungsten carbide (WC), and the like.

The composition of the ceramic component 20 may be selected based on the composition of the metallic component 18, and vise versa. In a particular implementation, a metal element may be common to both the metallic component 18 and the ceramic component 20. In one expression, titanium may be common to both the metallic component 18 and the ceramic component 20. In another expression, aluminum may be common to both the metallic component 18 and the ceramic component 20. In yet another expression, chromium may be common to both the metallic component 18 and the ceramic component 20.

Thus, the body 12 of the compositionally-graded structure 10 may be formed from a material system that includes both a metallic component 18 and a ceramic component 20. While the compositions of the metallic component 18 and the ceramic component 20 are design choices that may widely vary without departing from the scope of the present disclosure, it is believed that certain advantages may be gained by selecting a material system in which there is a metal element common to both the metallic component 18 and the ceramic component 20. Specific, non-limiting examples of such material systems include titanium alloy/titanium diboride; titanium alloy/titanium boride/titanium diboride; titanium alloy/titanium boride; titanium alloy/titanium carbide; aluminum alloy/aluminum oxide; nickel-chromium alloy/chromium carbide.

As shown in FIG. 1, the composition of the body 12 of the compositionally-graded structure 10 may be graded along the thickness axis T of the body 12. Therefore, the concentrations of the metallic component 18 and the ceramic component 20 within the body 12 are functions of location within the body 12 along the thickness axis T. Significantly, transitions of the concentrations of the metallic component 18 and the ceramic component 20 within the body 12 are continuous, which is to say that distinct interfaces (e.g., layers) are not macroscopically established within the body 12.

Figure 2:
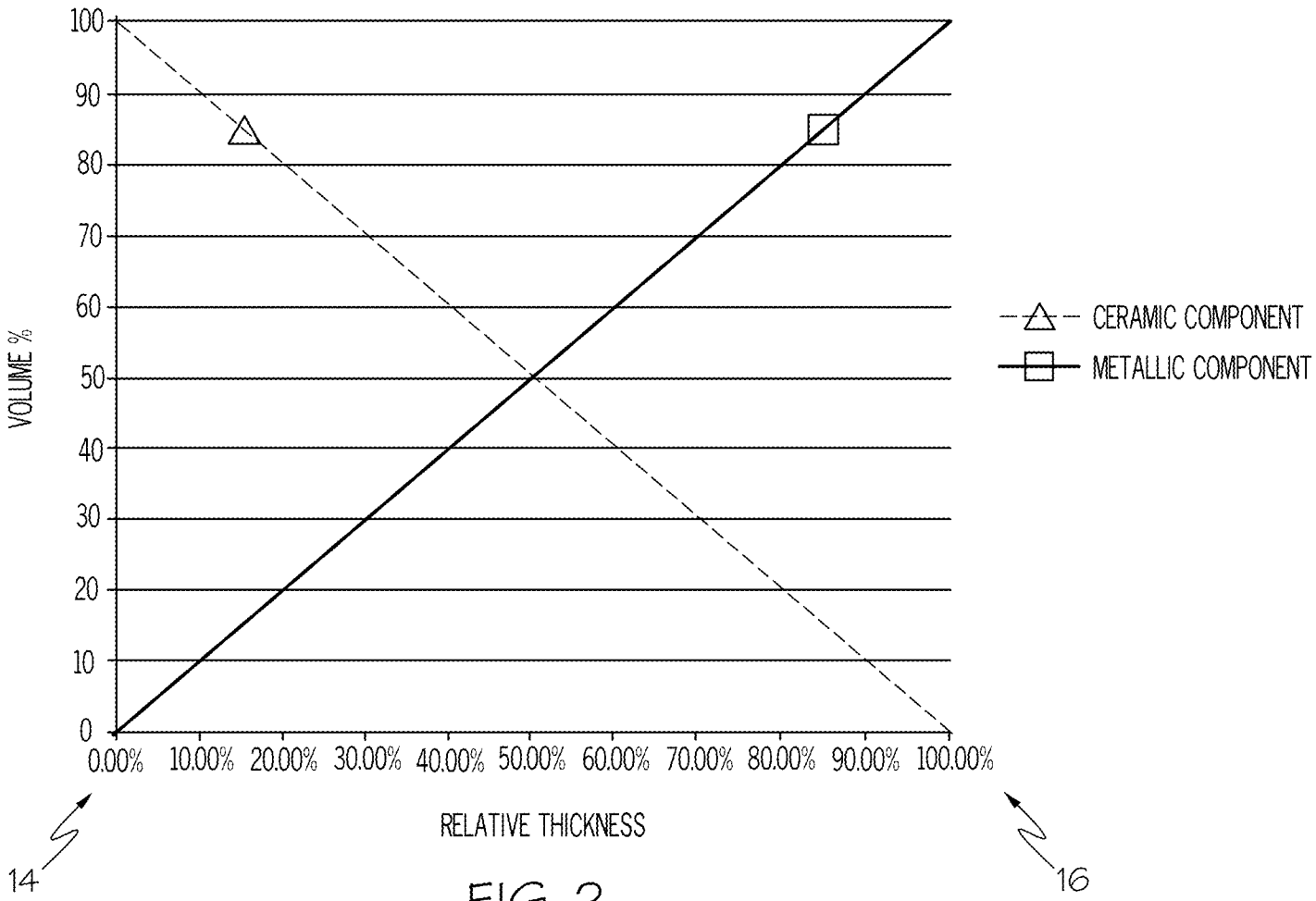
FIG. 2 is a graphical depiction of the compositional distribution (percent by volume versus position) of the compositionally-graded structure of FIG. 1.

Referring to FIG. 2, the concentrations of the metallic component 18 and/or the ceramic component 20 versus location within the body 12 along the thickness axis T may be substantially linear functions. The concentration of the metallic component 18 may linearly transition from a relatively low concentration proximate (at or near) the first major surface 14 to a relatively high concentration proximate the second major surface 16, while the concentration of the ceramic component 20 may linearly transition from a relatively high concentration proximate the first major surface 14 to a relatively low concentration proximate the second major surface 16. Therefore, depending upon location within the body 12 along the thickness axis T, compositionally the body 12 may be substantially ceramic, substantially metallic or some combination of ceramic and metallic.

As one specific, non-limiting example, the concentration of the metallic component 18 may linearly transition from zero (or about zero) proximate the first major surface 14 to about 100 percent by volume proximate the second major surface 16, while the concentration of the ceramic component 20 may linearly transition from about 100 percent by volume proximate the first major surface 14 to zero (or about zero) proximate the second major surface 16.

As another specific, non-limiting example, the concentration of the metallic component 18 may linearly transition from at most about 5 percent by volume proximate the first major surface 14 to at least about 90 percent by volume proximate the second major surface 16, while the concentration of the ceramic component 20 may linearly transition from at least about 95 percent by volume proximate the first major surface 14 to at most about 10 percent by volume proximate the second major surface 16.

As yet another specific, non-limiting example, the concentration of the metallic component 18 may linearly transition from at most about 5 percent by volume proximate the first major surface 14 to at least about 80 percent by volume proximate the second major surface 16, while the concentration of the ceramic component 20 may linearly transition from at least about 95 percent by volume proximate the first major surface 14 to at most about 20 percent by volume proximate the second major surface 16.

Alternatively, the concentrations of the metallic component 18 and/or the ceramic component 20 versus location within the body 12 along the thickness axis T may be non-linear functions. In one variation, the concentration of the metallic component 18 may transition from a relatively low concentration proximate the first major surface 14 to a relatively high concentration proximate the second major surface 16, while the concentration of the ceramic component 20 may transition from a relatively high concentration proximate the first major surface 14 to a relatively low concentration proximate the second major surface 16. In another variation, the concentration of the metallic component 18 may transition from a relatively low concentration proximate the first major surface 14 to a relatively high concentration between the first and second major surfaces 14, 16, and then back to a relatively low concentration proximate the second major surface 16. In yet another variation, the concentration of the ceramic component 20 may transition from a relatively low concentration proximate the first major surface 14 to a relatively high concentration between the first and second major surfaces 14, 16, and then back to a relatively low concentration proximate the second major surface 16. Therefore, the composition of the body 12 may be continuously transitioned in numerous ways along the thickness axis T.

Figure 3:
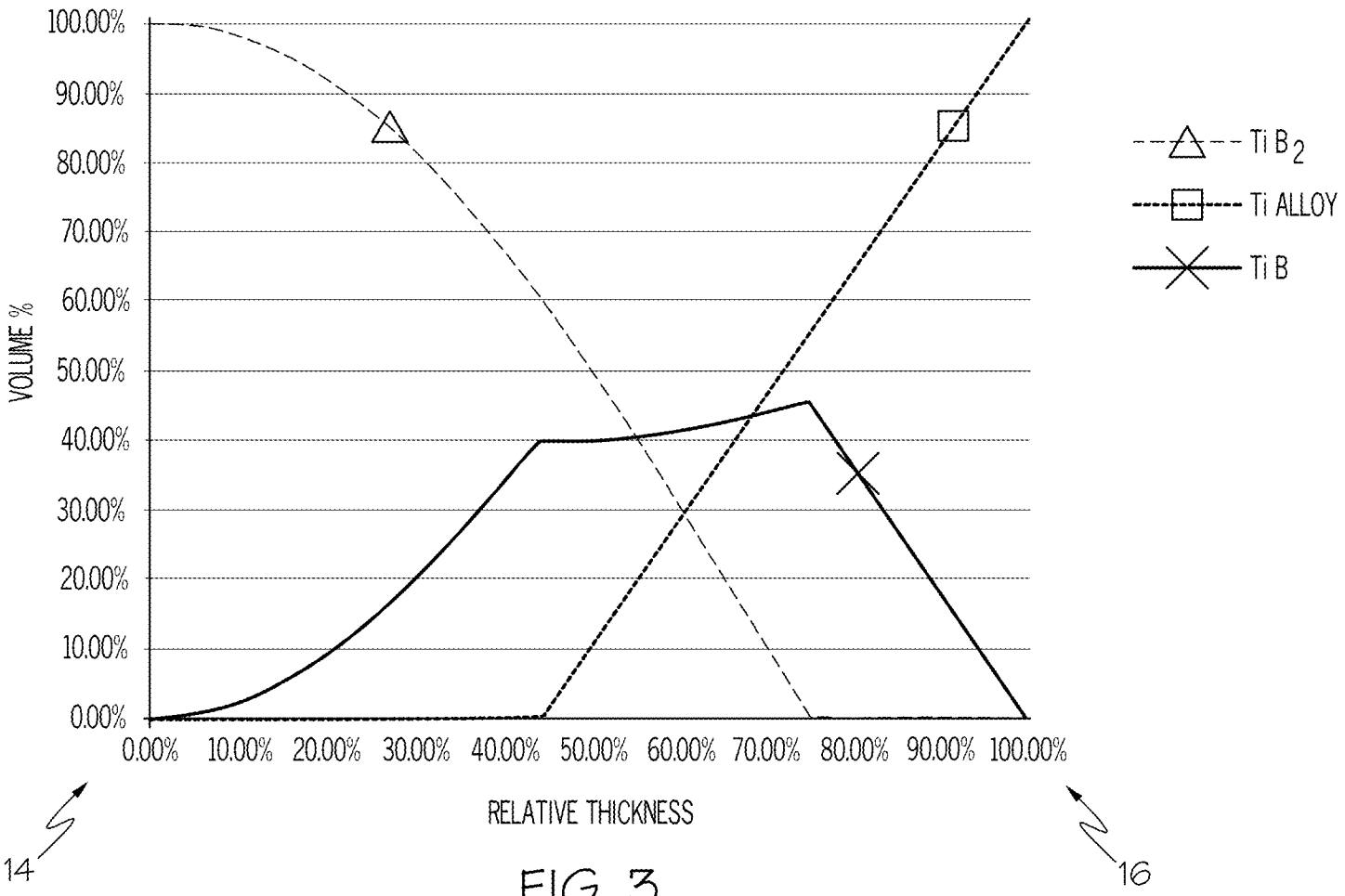
FIG. 3 is a graphical depiction of one alternative, though non-limiting, example of a compositional distribution of the disclosed compositionally-graded structure.

Referring to FIG. 3, as one specific, non-limiting example, the body 12 of the compositionally-graded structure 10 may include a titanium alloy (e.g., Ti-6Al-4V) as the metallic component 18 and both titanium diboride and titanium boride as the ceramic component 20. The concentrations of titanium diboride and titanium boride (ceramic component 20) within the body 12 along the thickness axis T are non-linear functions of location, while the concentration of the titanium alloy (metallic component 18) within the body 12 along the thickness axis T is a linear function of location.

Figure 4:
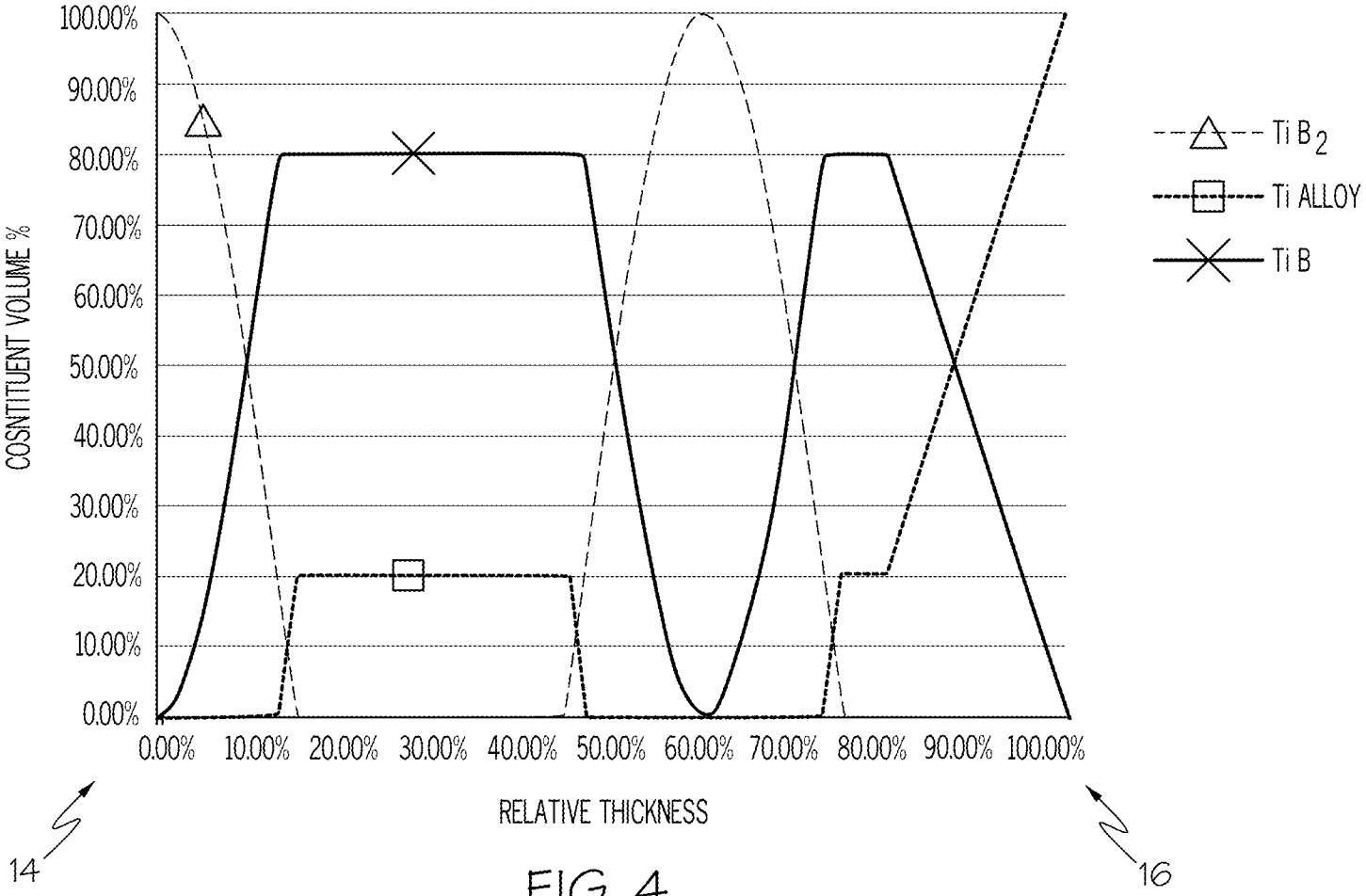
FIG. 4 is a graphical depiction of another alternative, though non-limiting, example of a compositional distribution of the disclosed compositionally-graded structure.

Referring to FIG. 4, as another specific, non-limiting example, the body 12 of the compositionally-graded structure 10 may include a titanium alloy (e.g., Ti-6Al-4V) as the metallic component 18 and both titanium diboride and titanium boride as the ceramic component 20. The concentrations of titanium diboride and titanium boride (ceramic component 20) within the body 12 along the thickness axis T are non-linear functions of location, and the concentration of the titanium alloy (metallic component 18) within the body 12 along the thickness axis T is also a non-linear function of location.

The disclosed compositionally-graded structure 10 may have a relatively high concentration of the ceramic component 20 at at least one location within the body 12 along the thickness axis T. The location having a relatively high concentration of the ceramic component 20 may be proximate the first major surface 14 of the body 12, though various other configurations are also contemplated and will not result in a departure from the scope of the present disclosure. As one example, the concentration of the ceramic component 20 may be at least about 95 percent by volume at at least one location within the body 12 along the thickness axis T. As another example, the concentration of the ceramic component 20 may be at least about 96 percent by volume at at least one location within the body 12 along the thickness axis T. As another example, the concentration of the ceramic component 20 may be at least about 97 percent by volume at at least one location within the body 12 along the thickness axis T. As another example, the concentration of the ceramic component 20 may be at least about 98 percent by volume at at least one location within the body 12 along the thickness axis T. As another example, the concentration of the ceramic component 20 may be at least about 99 percent by volume at at least one location within the body 12 along the thickness axis T. As yet another example, the concentration of the ceramic component 20 may be about 100 percent by volume at at least one location within the body 12 along the thickness axis T.

Figure 5:
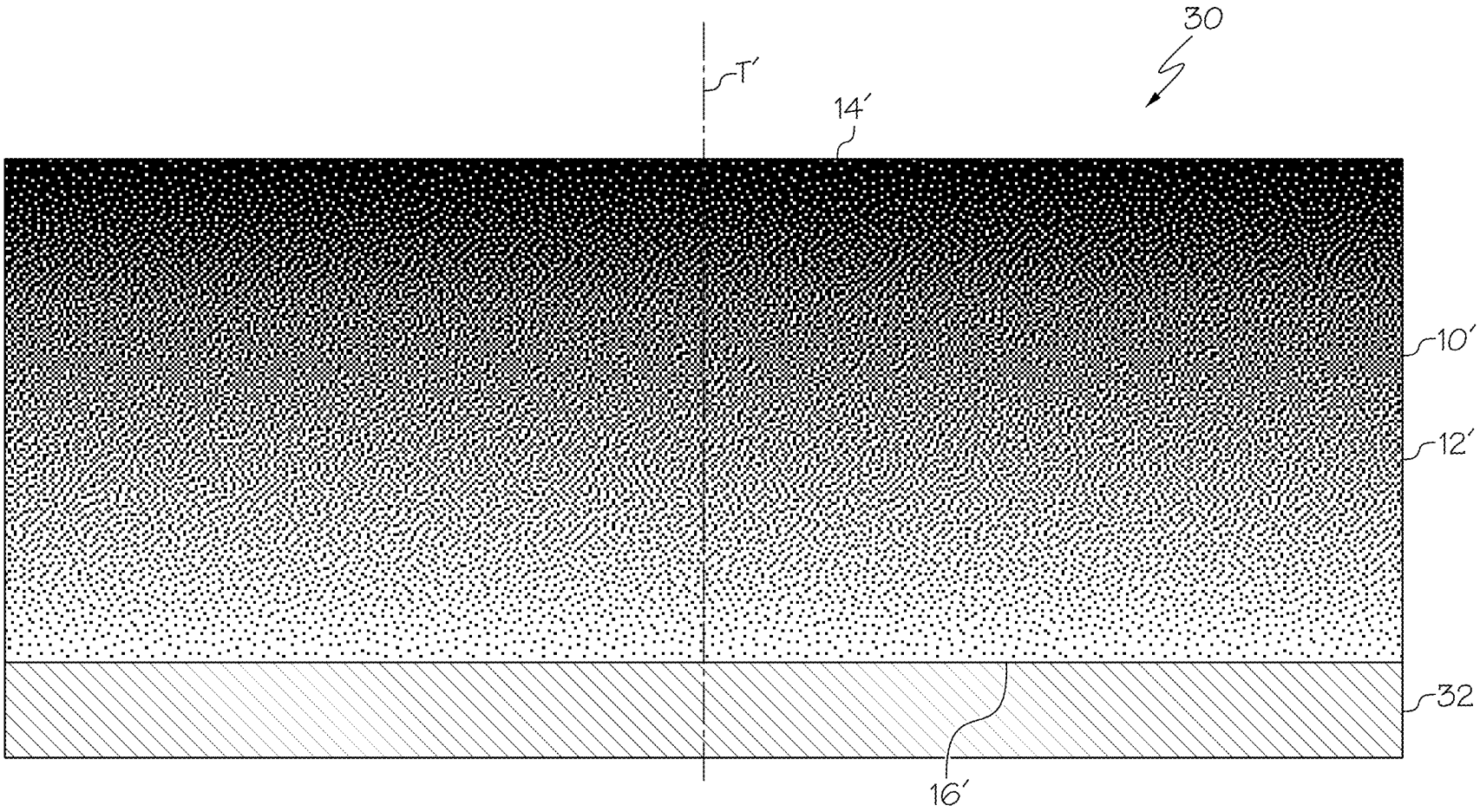
FIG. 5 is a schematic cross-sectional view of an article (an armor panel) incorporating the disclosed compositionally-graded structure.

Referring to FIG. 5, one example of the disclosed armor panel, generally designated 30, may include the disclosed compositionally-graded structure 10' and an anti-spalling layer 32 adjacent to the compositionally-graded structure 10'. Additional layers may be included in the disclosed armor panel 30 without departing from the scope of the present disclosure.

In one particular construction, the concentration of the metallic component 18 (FIG. 1) of the body 12' of the compositionally-graded structure 10' may be relatively low proximate the first major surface 14' and relatively high proximate the second major surface 16', while the concentration of the ceramic component 20 (FIG. 1) may be relatively high proximate the first major surface 14' to a relatively low proximate the second major surface 16'. Therefore, the anti-spalling layer 32 may be positioned adjacent to the second major surface 16' of the body 12' of the compositionally-graded structure 10'.

Various materials may be used to form the anti-spalling layer 32 of the disclosed armor panel 30. As one specific, non-limiting example, the anti-spalling layer 32 may be formed from (or may include) high-density polyethylene. As another specific, non-limiting example, the anti-spalling layer 32 may be formed from (or may include) aramid fibers. The cross-sectional thickness of the anti-spalling layer 32 (relative to the thickness axis T' of the compositionally-graded structure 10') may be a design consideration, and may vary depending on, for example, the cross-sectional thickness of the compositionally-graded structure 10'.

Figure 6:
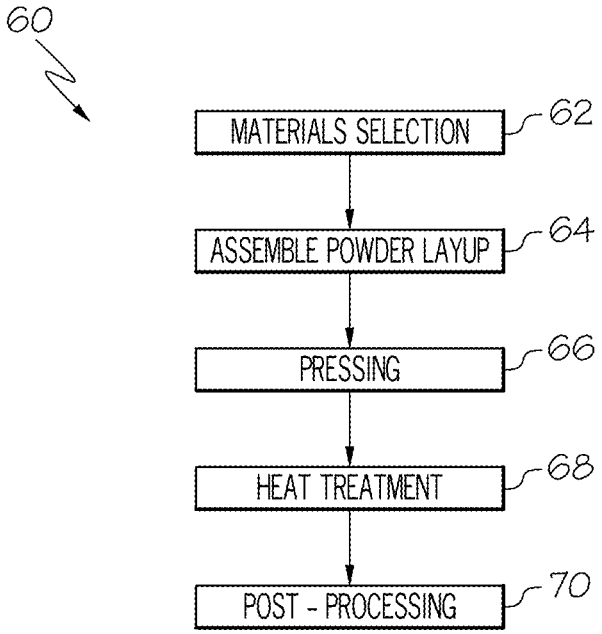
FIG. 6 is a flow diagram depicting one example of the disclosed method for manufacturing a compositionally-graded structure.

Referring to FIG. 6, disclosed is a method, generally designated 60, for manufacturing the disclosed compositionally-graded structure. The disclosed method 60 employs powder processing techniques to yield a compositionally-graded structure having a body that includes a metallic component and a ceramic component, wherein concentrations of the metallic component and the ceramic component in the body are functions of location within the body along the thickness axis of the body, and wherein transitions of the concentrations of the metallic component and the ceramic component in the body are continuous such that distinct interfaces are not macroscopically established within the body.

The method 60 may begin at Block 62 with step of materials selection. The materials selection step may include selecting at least one metallic component (in powdered form) and at least one ceramic component (in powdered form) for use in subsequent steps of the method 60. Non-limiting examples of suitable metallic components and suitable ceramic components are disclosed herein. Optionally, the metallic component and the ceramic component may be selected such that a metal element is common to both the metallic component and the ceramic component. For example, the metallic component may be a powdered titanium alloy (e.g., Ti-6Al-4V) and the ceramic component may be a powdered titanium-containing ceramic material, such as titanium diboride, titanium boride and/or titanium carbide.

At Block 64, the metallic component and the ceramic component selected at Block 62 may be used to assemble a powder layup having a plurality of layers of powdered material. In one expression, assembling a powder layup includes laying up at least three layers of powdered material. In another expression, assembling a powder layup includes laying up at least five layers of powdered material. In yet another expression, assembling a powder layup includes laying up at least ten layers of powdered material. Without being limited to any particular theory, it is believed that using a powder layup having a greater number of layers of powdered material may result in a compositionally-graded structure having a smoother transition in composition across the thickness axis.

Adjacent layers (if not all layers) of powdered material of the powder layup may have different compositions, with each layer being formed from the metallic component (unmixed), the ceramic component (unmixed) or by thoroughly mixing (e.g., by shaking, using a rotary ball mixer, or any other mixing procedure) the metallic component and the ceramic component in different ratios. Each layer of the powder layup may include at least one of the metallic component and the ceramic component, wherein the concentration of the metallic component ranges from 0 to 100 percent by volume and the concentration of the ceramic component ranges from 0 to 100 percent by volume.

Figure 7:
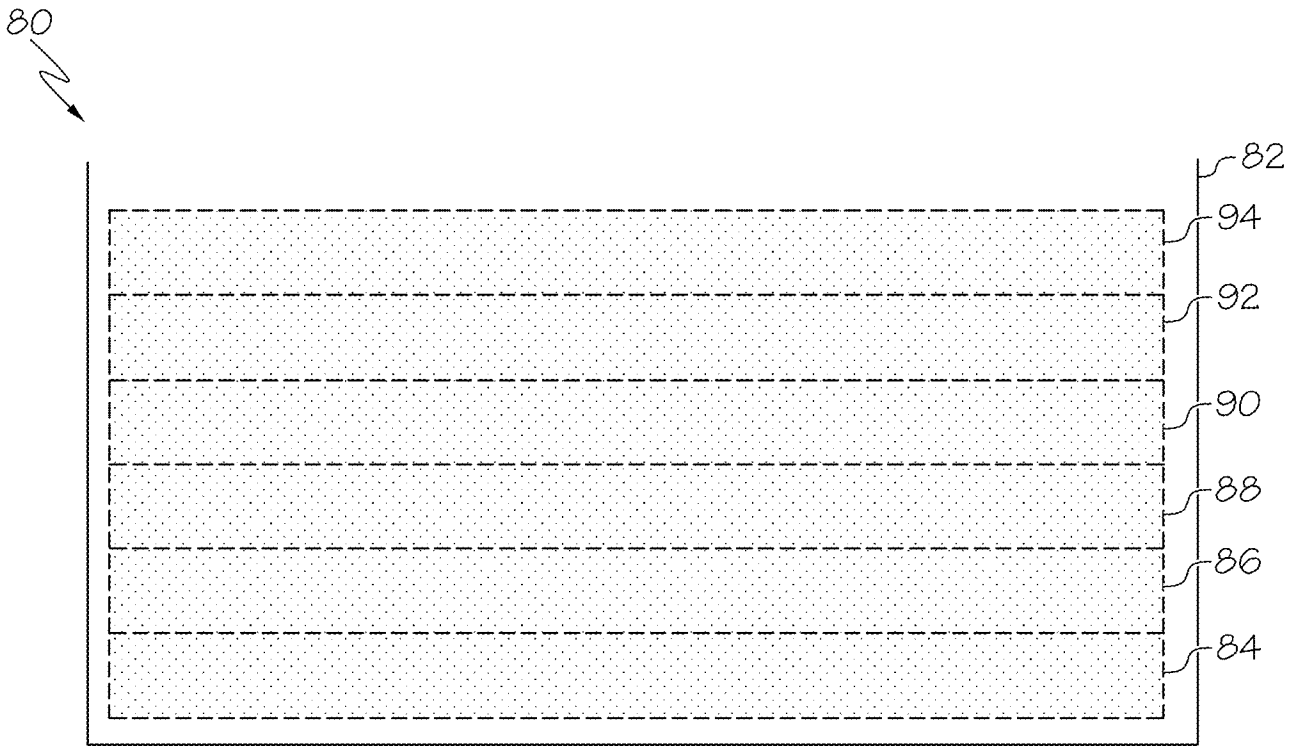
FIG. 7 is a schematic representation of an example powder layup formed pursuant to the method of FIG. 6.

A non-limiting example powder layup 80 (contained in a die 82) is shown in FIG. 7. The example powder layup 80 includes six layers 84, 86, 88, 90, 92, 94. The first layer 84 of the powder layup 80 includes about 100 percent by weight of the metallic component. The second layer 86 of the powder layup 80 includes a mixture containing about 80 percent by weight of the metallic component and about 20 percent by weight of the ceramic component. The third layer 88 of the powder layup 80 includes a mixture containing about 60 percent by weight of the metallic component and about 40 percent by weight of the ceramic component. The fourth layer 90 of the powder layup 80 includes a mixture containing about 40 percent by weight of the metallic component and about 60 percent by weight of the ceramic component. The fifth layer 92 of the powder layup 80 includes a mixture containing about 20 percent by weight of the metallic component and about 80 percent by weight of the ceramic component. The sixth layer 94 of the powder layup 80 includes about 100 percent by weight of the ceramic component.

At Block 66, the powder layup assembled at Block 64 may be pressed to form a compact that is not yet synthesized. As shown in FIG. 7, the powder layup 80 may be assembled in a die 82 and the die 82 may be pressed (e.g., by a plug that is sized and shaped to engage the die 82), such as in a hydraulic press (not shown), under ambient conditions to yield a compact. Pressing (Block 66) may be performed at pressures ranging, for example, from about 10 kpsi to about 16 kpsi.

Rather than pressing (Block 66) the fully assembled powder layup, one alternative approach to pressing (Block 66) includes pressing each layer of powdered material as it is added to the powder layup. For example, referring to FIG. 7, a first layer 84 of powdered material may be laid down (Block 64) and then pressed (Block 66). Then a second layer 86 of powdered material may be layered over the pressed first layer 84, and the combination of the pressed first layer 84 and the unpressed second layer 86 may be pressed, and so on. Another alternative approach to pressing (Block 66) includes pressing two or more adjacent layers of powdered material prior to adding additional layers of powdered material.

At this point, those skilled in the art will appreciate that, while assembling the powder layup (Block 64) and pressing (Block 66) are shown in FIG. 6 as two separate steps, the steps of assembling the powder layup (Block 64) and pressing (Block 66) may be performed simultaneously without departing from the scope of the present disclosure.

At Block 68, the compact formed at Block 66 may be heat treated to form a consolidated mass (the compositionally-graded structure). Various heat treatments may be used at Block 68 without departing from the scope of the present disclosure.

In one implementation, the heat treatment step (Block 68) includes hot pressing. The hot pressing process may include one or more consolidating process parameters, such as a consolidating pressure, a consolidating temperature and a consolidating time. The hot pressing process may be performed by any suitable hot pressing apparatus, such as a graphite press, operating under the consolidating process parameters. For example, the compact may be consolidated at the consolidating temperature and under the consolidating pressure for a period of time (e.g., the consolidating time). The hot pressing process may be performed under inert conditions (e.g., argon gas).

Those skilled in the art will appreciate that the hot pressing process consolidating process parameters will depend on the composition of the metallic component and the ceramic component used to form the compact. For example, when a titanium alloy/titanium diboride material system is used, hot pressing (Block 68) may be performed at a temperature ranging from about 800° C. to about 1,400° C. and a pressure ranging from about 40 MPa to about 50 MPa for at least about 30 minutes (e.g., one hour).

In another implementation, the heat treatment step (Block 68) includes hot isostatic pressing (HIPing or HIP consolidating). The hot isostatic pressing process may include one or more consolidating process parameters, such as a consolidating pressure, a consolidating temperature and a consolidating time. The hot isostatic pressing process may be performed by any suitable hot isostatic pressing apparatus operating under the consolidating process parameters. For example, the compact may be consolidated at the consolidating temperature and under the consolidating pressure for a period of time (e.g., the consolidating time). The hot isostatic pressing process may be performed using a commercially available hot isostatic pressing machine.

Those skilled in the art will appreciate that the hot isostatic pressing process consolidating process parameters will depend on the composition of the metallic component and the ceramic component used to form the compact. For example, when a titanium alloy/titanium diboride material system is used, hot isostatic pressing (Block 68) may be performed at a temperature ranging from about 1400° C. to about 1,800° C. and a pressure ranging from about 150 MPa to about 250 MPa for at least about 30 minutes (e.g., one to two hours).

At Block 70, the consolidated mass formed at Block 68 may optionally be subjected to one or more post-processing operations. Examples of post-processing operations include, without limitation, trimming, machining and the like.

Figure 8:
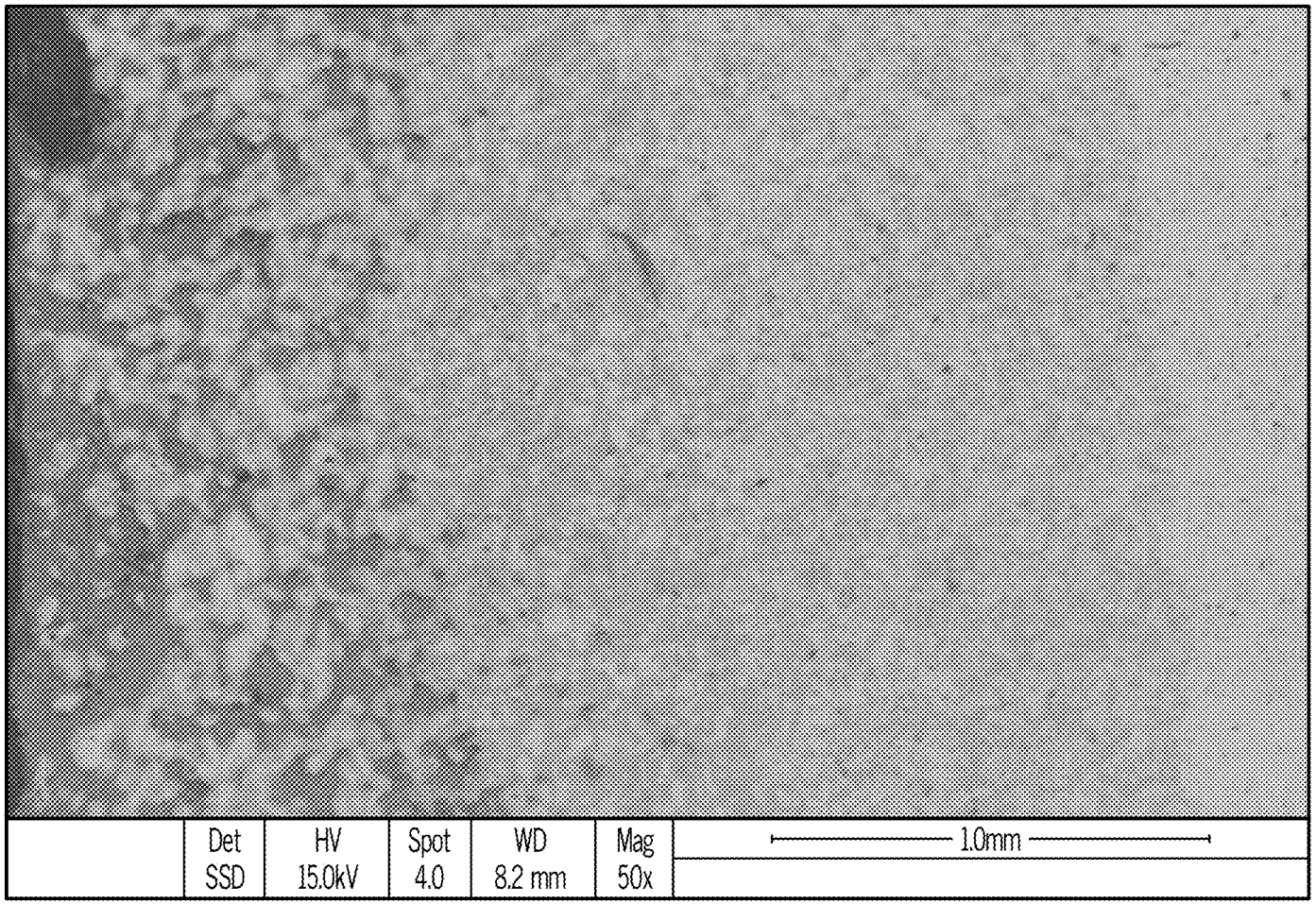
FIG. 8 is a scanning electron microscope backscattered electron micrograph of a sample compositionally-graded structure formed pursuant to the method of FIG. 6.

Referring to FIG. 8, there is shown a scanning electron microscope backscattered electron micrograph of a sample compositionally-graded structure formed pursuant to the method 60 of FIG. 6. The sample was prepared by hot isostatic pressing a compact at 1700° C. and 200 MPa for 2 hours. The compact was formed from a powder layup having six layers of powdered material (100 percent by weight metallic component; 80/20; 60/40; 40/60; 20/80; 0 percent by weight metallic component) using powdered Ti-6Al-4V as the metallic component and powdered titanium diboride as the ceramic component. As shown in FIG. 8, the sample exhibited a primarily ceramic composition proximate the first major surface (top of the image) and a primarily metallic composition proximate the second major surface (bottom of the image), with a continuous transition in concentration (no distinct interfaces).

Accordingly, the disclosed compositionally-graded structure may be suitable for use as (or in) high-energy impact protection apparatus (e.g., armor panels). The continuous transition from primarily ceramic material to primarily metallic material has the potential to slow impact wave propagation, which may provide greater impact energy absorption, thereby reducing the amount (and weight) of material required for high-energy impact protection. Furthermore, the continuous transition from primarily ceramic material to primarily metallic material may offer greater multi-hit performance.

Figure 9:
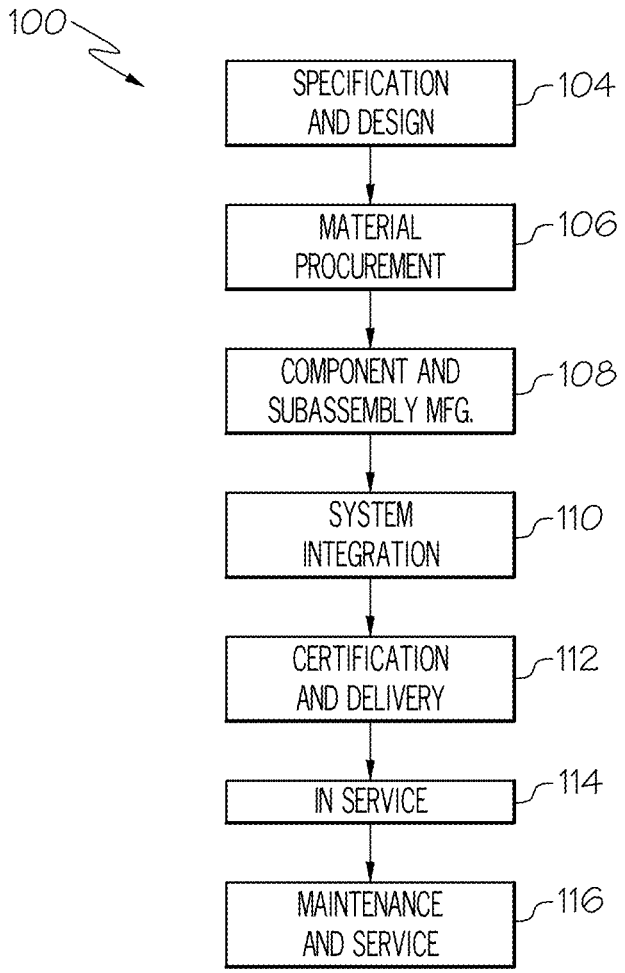
FIG. 9 is a flow diagram of an aircraft manufacturing and service methodology.
Figure 10:
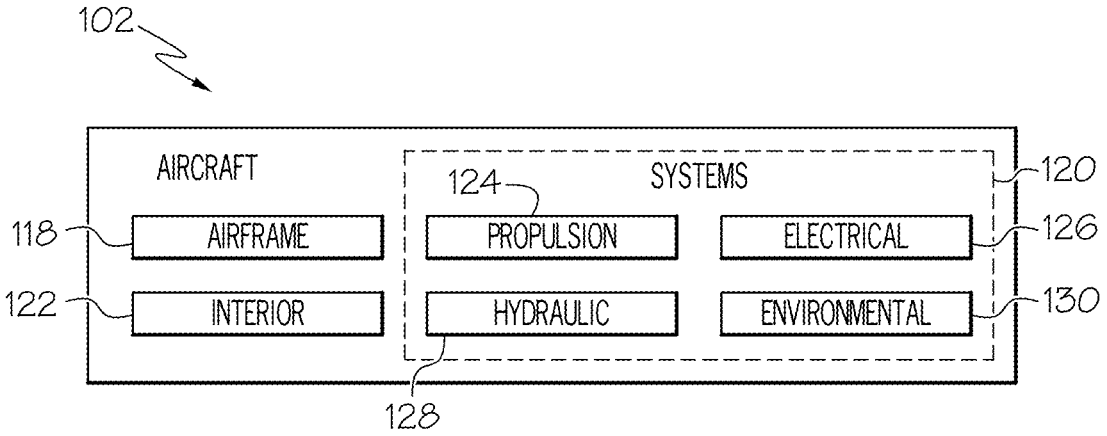
FIG. 10 is a block diagram of an aircraft.

Examples of the disclosure may be described in the context of an aircraft manufacturing and service method 100, as shown in FIG. 9, and an aircraft 102, as shown in FIG. 10. During pre-production, the aircraft manufacturing and service method 100 may include specification and design 104 of the aircraft 102 and material procurement 106. During production, component/subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116, which may also include modification, reconfiguration, refurbishment and the like.

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 10, the aircraft 102 produced by example method 100 may include an airframe 118 with a plurality of systems 120 and an interior 122. Examples of the plurality of systems 120 may include one or more of a propulsion system 124, an electrical system 126, a hydraulic system 128, and an environmental system 130. Any number of other systems may be included.

The disclosed compositionally-graded metal-ceramic structures and methods may be employed during any one or more of the stages of the aircraft manufacturing and service method 100. As one example, components or subassemblies corresponding to component/subassembly manufacturing 108, system integration 110, and or maintenance and service 116 may be fabricated or manufactured using the disclosed compositionally-graded metal-ceramic structures and methods. As another example, the airframe 118 may be constructed using the disclosed compositionally-graded metal-ceramic structures and methods. Also, one or more apparatus examples, method examples, or a combination thereof may be utilized during component/subassembly manufacturing 108 and/or system integration 110, for example, by substantially expediting assembly of or reducing the cost of an aircraft 102, such as the airframe 118 and/or the interior 122. Similarly, one or more of system examples, method examples, or a combination thereof may be utilized while the aircraft 102 is in service, for example and without limitation, to maintenance and service 116.

The disclosed compositionally-graded metal-ceramic structures and methods are described in the context of an aircraft (e.g., helicopters). However, one of ordinary skill in the art will readily recognize that the disclosed compositionally-graded metal-ceramic structures and methods may be utilized for a variety of applications. For example, the disclosed compositionally-graded metal-ceramic structures and methods may be implemented in various types of vehicles including, for example, passenger ships, automobiles, marine products (boats, motors, etc.) and the like. Various non-vehicle applications, such as body armor, are also contemplated.

Although various examples of the disclosed compositionally-graded metal-ceramic structures, armor panels, and methods have been shown and described, modifications may occur to those skilled in the art upon reading the specification. The present application includes such modifications and is limited only by the scope of the claims.

What is claimed is:

1. A method for manufacturing a compositionally-graded structure comprising:

assembling a powder layup comprising at least a first powdered material and a second powdered material, said first powdered material comprising a ceramic component and said second powdered material comprising a metallic component, said powder layup comprising:

a first layer comprising a first concentration of said ceramic component, said first concentration of said ceramic component being at least 80 percent by weight;

a second layer comprising a second concentration of said ceramic component and a first concentration of said metallic component; and a third layer comprising a third concentration of said ceramic component and a second concentration of said metallic component, said second concentration of said metallic component being at least 60 percent by weight;

pressing said powder layup to yield a compact;

heat treating said compact; and providing an anti-spalling layer adjacent to said compositionally-graded structure, wherein the anti-spalling layer comprises at least one of a polymer and a fiber.

2. The method of claim 1 wherein a metal element is present in said metallic component, and wherein said metal element is also present in said ceramic component.

3. A method for manufacturing a compositionally-graded structure comprising:

assembling a powder layup comprising at least a first powdered material and a second powdered material, said first powdered material comprising a ceramic component and said second powdered material comprising a metallic component, wherein said metallic component comprises a titanium alloy, said powder layup comprising:

a first layer comprising a first concentration of said ceramic component, said first concentration of said ceramic component being at least 80 percent by weight;

a second layer comprising a second concentration of said ceramic component and a first concentration of said metallic component; and a third layer comprising a third concentration of said ceramic component and a second concentration of said metallic component, said second concentration of said metallic component being at least 60 percent by weight;

pressing said powder layup to yield a compact; and heat treating said compact.

4. The method of claim 3 wherein said ceramic component comprises titanium diboride.

5. The method of claim 3 wherein said ceramic component comprises titanium boride.

6. The method of claim 3 wherein said ceramic component comprises titanium carbide.

7. The method of claim 1 wherein said assembling said powder layup comprises assembling said powder layup comprising at least five layers.

8. The method of claim 1 wherein said pressing said powder layup comprises pressing at a pressure ranging from about 10 kpsi to about 16 kpsi.

9. The method of claim 1 wherein said pressing said powder layup is performed after each layer of said powder layup is laid down.

10. The method of claim 1 wherein said heat treating comprises hot isostatic pressing.

11. The method of claim 1 wherein said heat treating comprises hot pressing.

12. The method of claim 1 further comprising, after heat treating, subjecting said compact to a post-processing operation.

13. The method of claim 1 wherein the anti-spalling layer comprises high-density polyethylene.

14. A method for manufacturing a compositionally-graded structure comprising:

assembling a powder layup comprising at least a first powdered material and a second powdered material, said first powdered material comprising a ceramic component and said second powdered material comprising a metallic component, said powder layup comprising:

a first layer comprising a first concentration of said ceramic component, said first concentration of said ceramic component being at least 80 percent by weight;

a second layer comprising a second concentration of said ceramic component and a first concentration of said metallic component; and a third layer comprising a third concentration of said ceramic component and a second concentration of said metallic component, said second concentration of said metallic component being at least 60 percent by weight;

pressing said powder layup to yield a compact; and heat treating said compact, wherein said heat treating comprises hot pressing.

15. The method of claim 14 wherein said hot pressing comprises hot isostatic pressing.

16. The method of claim 14 wherein a metal element is present in said metallic component, and wherein said metal element is also present in said ceramic component.

17. The method of claim 14 wherein said metallic component comprises a titanium alloy.

18. The method of claim 17 wherein said ceramic component comprises titanium diboride.

19. The method of claim 17 wherein said ceramic component comprises titanium boride.

20. The method of claim 17 wherein said ceramic component comprises titanium carbide.

* * * * *